US006848151B2

(12) United States Patent
Bakker et al.

(10) Patent No.: US 6,848,151 B2
(45) Date of Patent: Feb. 1, 2005

(54) AIR-JET METHOD FOR PRODUCING COMPOSITE ELASTIC YARNS

(75) Inventors: Willem Bakker, Divonne (FR); Bernd Pulvermacher, Divonne (CH); Michel Verdan, Geneva (CH); Nicolas Philippe Berthoud, L'Eglise Vieille (FR)

(73) Assignee: Invista Norh America S.à.r.l, Wilmington, DE (US)

( * ) Notice: Subject to any disclaimer, the term of this patent is extended or adjusted under 35 U.S.C. 154(b) by 66 days.

(21) Appl. No.: 10/404,203

(22) Filed: Mar. 31, 2003

(65) Prior Publication Data

US 2004/0194267 A1 Oct. 7, 2004

(51) Int. Cl.[7] ..... D02J 1/08

(52) U.S. Cl. ..... 28/271; 28/220; 28/240

(58) Field of Search ..... 28/271, 273, 274, 28/275, 276, 240, 245, 246, 247, 220, 258; 57/238, 239, 6, 244, 908, 350, 245, 225, 226; 264/103, 210.8, 211.17, 290.5

(56) References Cited

U.S. PATENT DOCUMENTS

| | | | | |
|---|---|---|---|---|
| 3,013,379 A | * | 12/1961 | Leonard | 57/6 |
| 3,115,745 A | | 12/1963 | Lathem et al. | |
| 3,142,147 A | * | 7/1964 | Betsch | 57/246 |
| 3,387,448 A | | 6/1968 | Lathem et al. | |
| 3,940,917 A | | 3/1976 | Strachan | |
| 4,829,757 A | * | 5/1989 | Canton | 57/6 |
| 5,008,992 A | | 4/1991 | Gehrmann et al. | |
| 5,054,174 A | * | 10/1991 | Krenzer | 28/271 |
| 5,163,631 A | | 11/1992 | Borer | |
| 5,794,427 A | * | 8/1998 | Cavedon et al. | 57/290 |
| 5,908,170 A | | 6/1999 | Kunz | |
| 5,918,829 A | | 7/1999 | Fäh | |
| 6,301,760 B1 | | 10/2001 | Beard et al. | |
| 6,393,817 B1 | | 5/2002 | Coro | |

FOREIGN PATENT DOCUMENTS

| | | |
|---|---|---|
| DE | 1157704 | 7/1969 |

* cited by examiner

*Primary Examiner*—A. Vanatta
(74) *Attorney, Agent, or Firm*—Robert B. Furr, Jr.

(57) ABSTRACT

A continuous method for producing composite elastic yarns at speeds up to 700 m/min by (a) stretching (drafting) an elastomeric yarn (e.g., spandex) by 2.0×(100%) to 10.5×(950%) while heating (max. heating temperature 220° C.) in a single or double stage draft, (b) air-jet entangling with a relatively inelastic yarn component to create a composite elastic yarn, and then (c) in-line heat-treating (max. heating temperature 240° C.) the composite elastic yarn. The initial draft stage(s) may also be carried out at ambient temperature. The resulting composite elastic yarn has improved stitch clarity, particularly suited for hosiery, and its properties can be tailored to provide fabric properties for knit and woven fabrics hitherto not possible with standard spandex yarns.

27 Claims, 5 Drawing Sheets

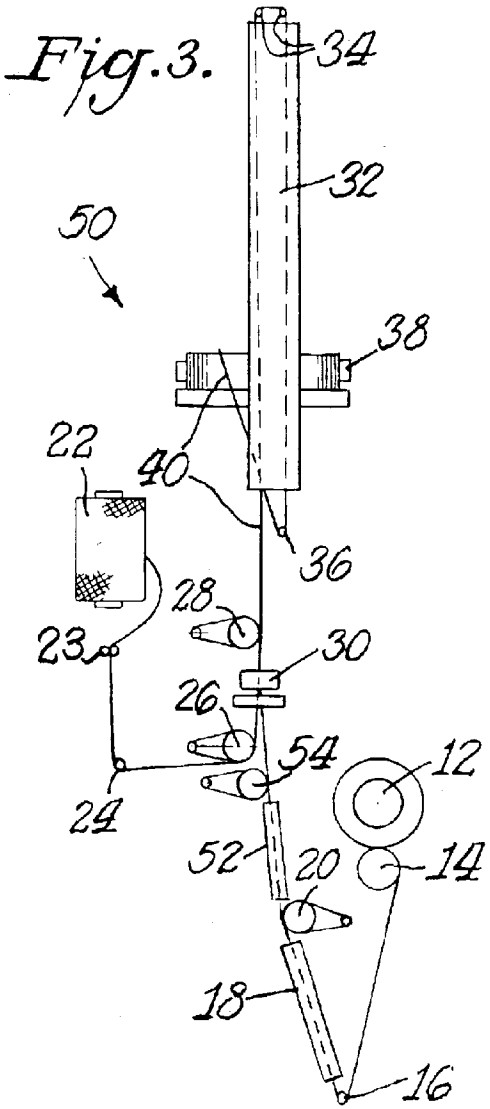
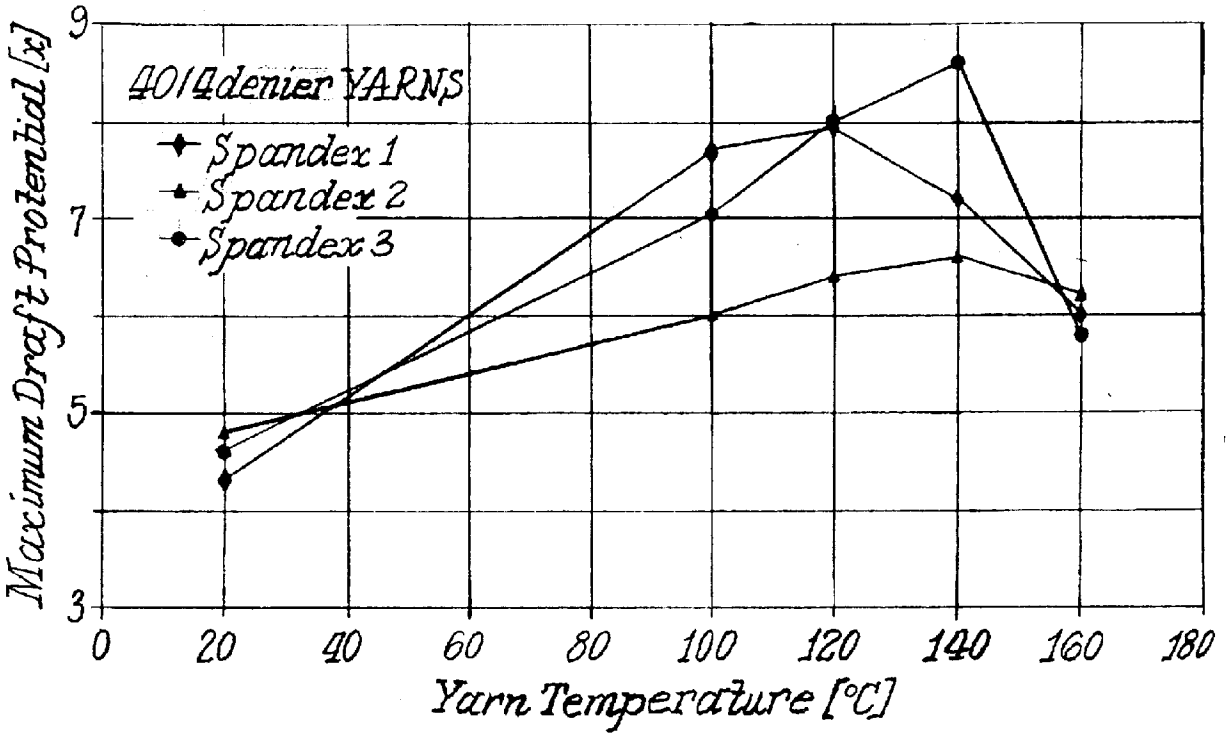
Fig. 4.

AIR-JET METHOD FOR PRODUCING COMPOSITE ELASTIC YARNS

FIELD OF THE INVENTION

This invention relates to elastic yarn that is made by combining an elastomeric yarn with a relatively inelastic yarn, and more particularly, to drafting the elastomeric yarn and combining the elastomeric and inelastic yarns using both air-jet entangling and heat treatment steps. The properties of the composite yarn can be economically tailored during manufacturing to provide improved and desired characteristics in knit and woven fabrics.

BACKGROUND OF THE INVENTION

Elastomeric yarns consist of single or multiple elastomeric fibers that are manufactured in fiber-spinning processes. By "elastomeric fiber" is meant a continuous filament which has a break elongation in excess of 100% independent of any crimp and which when stretched to twice its length, held for one minute, and then released, retracts to less than 1.5 times its original length within one minute of being released. Such fibers include, but are not limited to, rubbers, spandex or elastane, polyetheresters, and elastoesters. Elastomeric fibers are to be distinguished from "elastic fibers" or "stretch fibers" which have been treated in such a manner as to have the capacity to elongate and contract. Such fibers have modest power in contraction, and include, but are not necessarily limited to, fibers formed by false-twist texturing, crimping, etc.

For many years elastomeric fibers, such as spandex, have been covered with relatively inelastic fibers in order to facilitate acceptable processing for knitting or weaving, and to provide elastic composite yarns with acceptable characteristics for various end-use fabrics. The relatively inelastic fibers do not stretch and recover to the same extent as the elastomeric fibers. Examples of relatively inelastic yarns are synthetic polymers such as nylon or polyester. Within this specification, we will refer to the relatively inelastic fibers used for covering as "inelastic fibers" or "inelastic yarns".

Several methods of covering elastomeric fibers with inelastic fibers are known and in use, including hollow-spindle covering, core spinning, air-jet entangling and modified false-twist texturing. Each method has its various advantages and disadvantages, and therefore is used selectively for various inelastic feed yarns, composite elastic yarns and end-use fabrics.

Air-jet entangling as a covering process for spandex elastomeric yarn is described in U.S. Pat. No. 3,940,917 (Strachan). A primary advantage of this process, when compared to the hollow-spindle covering process, for example, is the process speed at which the spandex can be covered with multifilament synthetic inelastic yarns. A typical process speed for hollow-spindle covering is up to 25 meters/minute, whereas a typical speed for air-jet entangling is 500 meters/minute or greater, or about 20 times or more as productive. Air-jet covered composite yarns have some deficiencies, however, as noted in Strachan; specifically, such composite yarns have loops extending from the covering component that partially obscure knitted stitch openings, resulting in a more opaque (versus transparent) look to knitted hosiery. Further, in knitted hosiery the extending loops increase the likelihood that difficulties will be encountered during the knitting operation and when the finished hosiery is in use. For example, the extending loops are more likely to be snagged or picked to cause a pulled strand when the hosiery is worn, resulting in a ruined garment. To attempt to address this problem, the Strachan patent teaches that using bicomponent yarns for the covering component can greatly improve knit stitch openness by activating the differential shrinkage and twisting of the bicomponent yarns during the hosiery dyeing and finishing processes. Using a bicomponent covering yarn, however, adds further expense, and the industry seeks a less expensive method to achieve improved knit stitch openness.

The elastic properties of composite elastic yarns made from prior art air-jet covering processes are determined primarily by the elastic properties and denier of the elastomeric feed yarn. Elastic properties are characterized by yarn mechanical stress-strain performance, and related characteristics such as elongation-to-break, tenacity-at-break, elastic modulus, and recovery force at various yarn elongation. These elastic properties in turn relate to fabric properties, such as physical dimensions, fabric stretch-unload power, and degree of compression or comfort in use.

The cost of an air-jet covered composite elastic yarn is determined primarily by the material cost of the elastomeric yarn included in the composite. The material cost of elastomeric yarn, in turn, is determined by the weight proportion of elastomeric yarn in the composite yarn, and by the cost per pound of the elastomeric yarn. Importantly, the cost per pound of elastomeric yarn depends upon the linear density, or denier, of the yarn; that is, fine denier or small diameter as-spun elastomeric yarn is typically much more costly on a per pound basis. For many stretch garment applications, a fine denier elastomeric yarn is used to form the composite yarn in order to achieve desired garment properties of stretch, recovery and comfort. During the covering process the elastomeric yarn is typically stretched, or drafted, to provide needed operating tension and to reduce its denier while it is being covered with the inelastic yarn. This is true not only for the air-jet process, but for all prior-art covering processes. Drafting the elastomeric yarn to a finer denier before forming the composite yarn reduces cost because the elastomeric feed yarn is of a higher-denier, lower-cost as-spun yarn. It follows that achieving ever-higher draft ratios in the covering process could lead to further cost reduction.

There have been limits, however, to the extent to which the elastomeric yarn can be drafted. For example, U.S. Pat. No. 3,387,448 (Lathem) shows that spandex may be drawn (stretched) to 500% (6×) of its original length and stabilized to a fine denier upon heat setting at oven temperatures between 180° F. to 700° F., and GB1,157,704 indicates that elastomer filaments may be drawn to 700% (8×) upon heating at oven temperatures up to 300° C., depending upon the heating oven type and residence time of the filament within the heater. See also, U.S. Pat. No. 6,301,760 (Beard). Hence, the industry continues to seek means for achieving higher draft ratios in elastomeric yarn covering processes.

Because of the variety of garments that are manufactured with elastic-covered yarns, and because of the different fabric stretch characteristics that are needed for various garment end uses, it would be very advantageous if an elastomeric yarn could be covered with an inelastic yarn at high speeds with an air-jet entangling process to form a composite yarn, while simultaneously modifying and tailoring the elastic properties of the resulting composite elastic yarn. In many cases for different garment applications, this ability could eliminate the need to change the denier and/or specification of the feed elastomeric yarn in the air-jet covering process, or to modify the composite-yarn elastic properties in a secondary process. Although it was known that the properties of elastomeric yarns can be altered by heat treatments, the art does not teach the means or the operating conditions needed to achieve desirable tailoring of composite yarn elastic properties, while simultaneously producing the composite yarn in an air-jet entangling process, with attention to reducing costs by using higher denier elastomeric yarns as the starting material and covering such elastomeric yarns with monocomponent inelastic yarns. The industry would benefit from a continuous, high-speed method to simultaneously produce an air-jet entangled, covered and heat-treated composite elastic yarn, wherein the method improved knit stitch openness using monocomponent inelastic covering yarns, and/or reduced the cost of said composite elastic yarns, as compared with prior air-jet covering methods, and/or desirably tailored the elastic properties of knit or woven fabrics from said composite yarns.

SUMMARY OF THE INVENTION

In a first aspect, the invention is a method for producing a composite elastic yarn that includes the steps of: (a) stretching an elastomeric yarn of 10 to 140 denier and 1 to 15 coalesced filaments to from 2.0 to 7.0 times its relaxed length while heating the yarn to a temperature in the range of about 80° C. to about 150° C.; (b) jointly feeding the stretched elastomeric yarn and an inelastic yarn of 10 to 210 denier and having at least five filaments through a fluid entangling jet to entangle the elastomeric yarn and the inelastic yarn to form the composite elastic yarn, said inelastic yarn being supplied to the jet at an overfeed from 1.5% to 6.0%; (c) heating the composite elastic yarn to a maximum temperature of between about 150° C. and about 240° C.; and (d) cooling the heated composite yarn to an average temperature of about 60° C. or less, prior to winding the composite yarn into a package. Preferably, in step (a) the elastomeric yarn is heated in an in-line heater for a residence time less than 0.5 second. Preferably, in step (c) the composite elastic yarn is heated in an in-line heater for a residence time less than one second.

Preferably, the elastomeric yarn is spandex and is comprised of individual, however coalesced filaments having denier in the range of 6 to 25. Preferably, the inelastic yarn is a synthetic continuous multi-filament yarn, such as nylon or polyester.

In the preferred method the composite elastic yarn exits the fluid entangling jet at a speed of from 350 to 700 meters per minute. In addition, the elastomeric yarn may be stretched up to an additional 2.0 times its length as the yarn is drawn through the fluid entangling jet.

According to a second aspect of the invention, the elastomeric yarn is drawn for a second time through a second heating zone before the elastomeric yarn and inelastic yarn are introduced into the entangling fluid jet. Thus, the elastomeric yarn of 10 to 140 denier and 1 to 15 filaments is stretched from 2.0 to 5.0 times its relaxed length while heating the yarn to a temperature in the range of about 80° C. to about 220° C. in a first heating zone. Then, the elastomeric yarn is further stretched an additional 2.0 to 3.0 times its stretched length while heating the yarn to a temperature in the range of about 80° C. to 220° C. in a second heating zone. Accordingly, the elastomeric yarn may be stretched a total of above eight and up to ten to fifteen times its relaxed length before the elastomeric yarn is fed to the entangling fluid jet. The remaining entangling, heating and cooling steps are then carried out in the same manner as in the first aspect of the invention.

In a third aspect of the invention, a method for producing a composite elastic yarn includes the steps of: (a) stretching an elastomeric yarn of 10 to 140 denier and 1 to 15 filaments to from 2.0 to 5.0 times its relaxed length while maintaining the yarn at an ambient temperature; (b) jointly feeding the stretched elastomeric yarn and an inelastic yarn of 10 to 210 denier and having at least five filaments through a fluid entangling jet to entangle the elastomeric yarn and the inelastic yarn to form the composite elastic yarn, said inelastic yarn being supplied to the jet at an overfeed from 1.5% to 6.0%; (c) heating the composite elastic yarn to a maximum temperature of between about 150° C. and about 240° C.; and (d) cooling the heated composite yarn to an average temperature of about 60° C. or less, prior to winding the composite yarn into a package. Alternatively, in step (b) the elastomeric yarn is further stretched up to 2.0 times its stretched length when passed through the fluid entangling jet.

The invention has particular advantage in forming composite elastic yarns with good stitch quality that may be formed into garments, including most particularly, hosiery. It was discovered that the elastomeric yarns, particularly spandex, could be drafted to finer denier under applied heat prior to entangling with inelastic yarns if the spandex composition, the denier per filament of the spandex yarn and the heating temperature in the drafting zone were optimized. In addition, adding a second drafting step before introducing the elastomeric yarn (particularly spandex) to the entangling jet enhanced the results. Even if the elastomeric yarn is not heated in the initial drafting zone(s) prior to entering the entangling jet, improvement in stitch clarity is obtained by heating the air-jet entangled composite elastic yarn.

BRIEF DESCRIPTION OF THE FIGURES

FIG. 3 is a schematic front elevational view of an alternative embodiment of drawing, air-jet covering and heating equipment that may be used to carry out the method of the invention;

FIG. 4 is a graph of maximum single-step draft potential versus yarn temperature that shows the effect of spandex composition and spandex temperature on the maximum single-step draft;

DETAILED DESCRIPTION OF THE PREFERRED EMBODIMENTS

Figure 1:
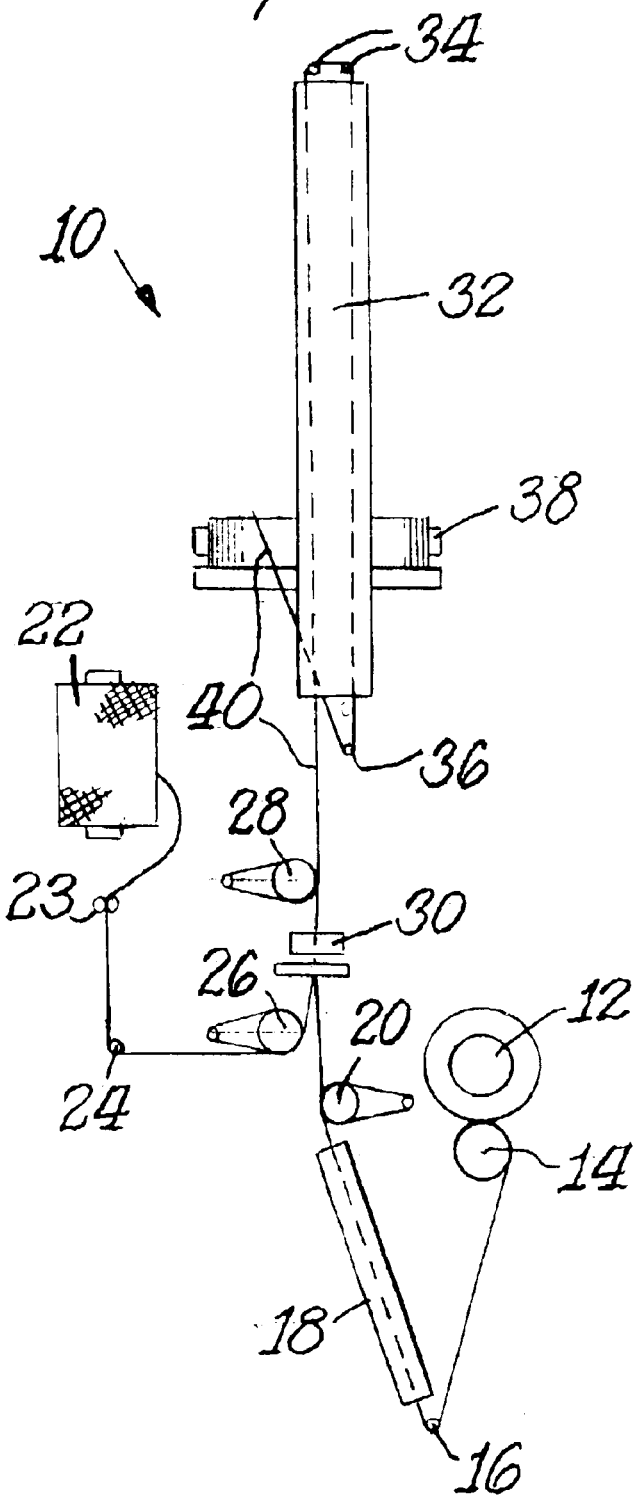
FIG. 1 is a schematic front elevational view of drawing, air-jet covering and heating equipment that may be used to carry out the method of the invention.
Figure 2:
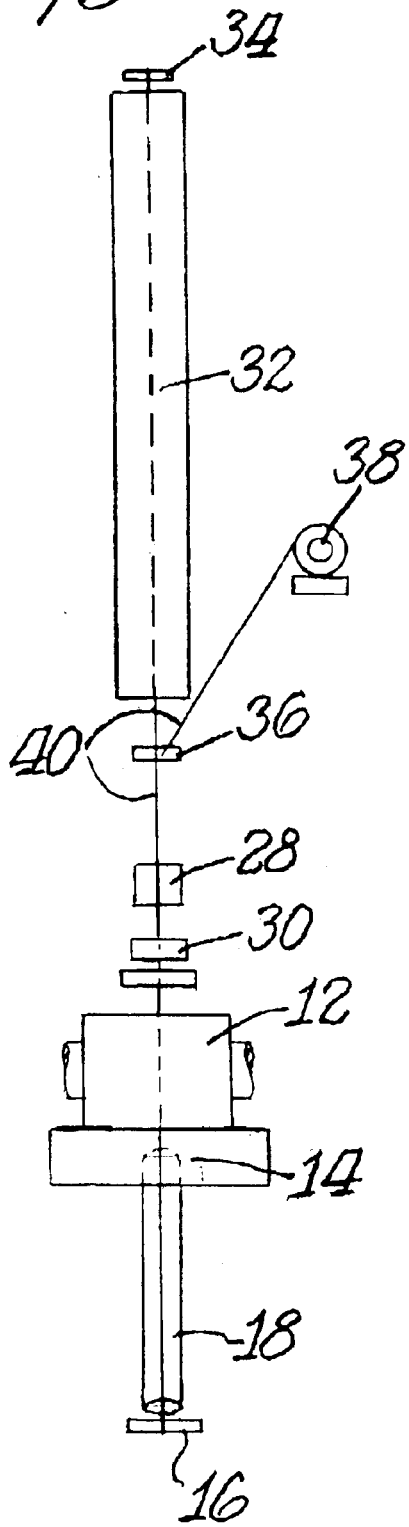
FIG. 2 is a schematic side elevational view of the equipment of FIG. 1.

Referring first to FIGS. 1 and 2, a commercial air-jet covering machine that has been modified to carry out the method of a first embodiment of the invention is shown. The commercial machine was a model SSM DP C from Schaerer Schweiter Mettler AG of Switzerland. It was modified to include non-contact in-line radiant heaters in the elastomeric yarn (e.g., spandex) drafting zone and to include a non-contact in-line convection heater after the entangling jet. The modified SSM machine 10 is shown schematically in FIGS. 1 and 2. While this modified SSM machine is shown to illustrate the inventive method, other air-jet covering machines could be used and other modifications could be made. The invention is not limited to particular types of heaters for the various heating zones or to particular types of drafting rolls. Changes in heater types, drafting roll diameters, and yarn path modifications to accommodate the available space and budgets are within the scope of the present invention.

The first, second and third embodiments of the inventive method for making a composite elastic yarn are described below with reference to using spandex as the elastomeric yarn component that forms the core of the composite elastic yarn. If spandex is selected as the elastomeric yarn, the spandex yarn can range from 10–140 denier with the number of filaments in the yarn ranging from 1 to 15, depending on the total spandex denier. In a spandex dry-spinning process, these filaments are typically coalesced so that the multifilament yarn is wound as a monofilament. Before coalescence, the denier per filament typically ranges between 6 and 25.

Referring to FIG. 1, a spandex yarn is supplied from supply package 12 at a controlled speed via controlled speed roll 14. The spandex yarn is transported through a guide 16 and through an in-line radiation type heater 18 to take-up controlled speed roll 20. The spandex is stretched, or drafted, between rolls 14 and 20, as the surface speed of roll 20 is greater than that of roll 14. For the modified SSM machine 10 illustrated, surface speed or drafting ratios between these rolls 14 and 20 ranges from 2.0× to 4.5×; however, roll 14 can be modified in diameter to allow for spandex drafts up to 10× in this equipment arrangement.

The spandex should be heated to a maximum temperature in the range of 80° C. to 150° C. Surface temperature of heater 18 will depend on the type of heater (contact or non-contact), the residence time of the spandex yarn in the heater, the denier of the spandex yarn and the spandex composition. For a contact heater, the surface temperature should stay below the zero-strength temperature of the spandex. (The "zero-strength temperature" is the temperature at which a yarn strand with a length of one meter breaks by its own weight. For most spandex compositions, the zero-strength temperature is generally in the range of 195° C. to 220° C.) A non-contact heater, such as a radiation or a convection heater, can have higher surface temperatures than the zero-strength temperature in order to raise the yarn temperature quickly when the yarn residence time in the heater is short. As shown in FIGS. 1 and 2, heater 18 is a radiation heater having a length of 40 centimeters. Its surface temperature may range from 100° C. to 300° C. for hot drafting in order to heat the spandex yarn to a desired temperature. Optionally, the spandex may be pre-heated before entering the heater 18, such as by contact heating with a heated roll (not shown).

Continuing with reference to FIGS. 1 and 2, the inelastic yarn is taken-off the yarn package 22 over-end and delivered through a guide and tensioning arrangement (23 to 24) at a controlled tension to the controlled speed roll 26. The inelastic yarn can be fully-drawn or partially drawn false-twist textured monocomponent yarn, or a fully drawn or partially drawn bicomponent yarn of 10–210 total denier with at least five filaments to achieve sufficient entanglement with and covering of the spandex. The inelastic yarn is forwarded to the entangling jet 30 from roll 26 with an overfeed, preferably from 1.5% to 6.0%. To achieve this overfeed, the surface speed of roll 26 is set at a surface speed relative to that of roll 28 of 1.5% to 6% greater than that of roll 28.

Concurrently, the spandex yarn is pulled through the entangling jet 30 by the action of roll 28. The surface speed of roll 28 is varied to be greater than or less than that of roll 20 with spandex machine draft ratios ranging from an overfeed of 2× to a draft of 2.0× between roll 20 and roll 28, and ranging from a draft of 2× to a draft of 7.0× between roll 14 and roll 28. The spandex is air-entangled with the inelastic yarn in the entangling jet 30 by the action of high-pressure fluid (e.g., air) supplied to the jet. The entangling jet 30 can be of a commercial type, such as Heberlein models P212 or P221 (from Heberlein in Switzerland), and operated at 5+/−1.5 bar. The yarn speeds through the jet can be in the range of 350 to 700 meters/minute.

The composite yarn 40 exits from the entangling jet 30 as spandex with a covering of inelastic yarn and is forwarded from roll 28 through a non-contact convection type in-line heater 32. Pictured in FIGS. 1 and 2, the convection type in-line heater 32 has a length of one meter. To heat the composite elastic yarn 40 sufficiently, the yarn 40 is passed through the heater 32 a first time, through guides 34 and through the heater 32 a second time. Thus, the yarn makes two complete passes through the heater 32, so that the yarn has a total pass length of two meters in the heater. The yarn 40 then passes through guide 36 and cools before it is wound on roll 38. The temperature range of the convection heater surface is 150° C. to 240° C. Proper choices of the wind-up speed on roll 38 in relation to roll speed of roll 28 enable tension control of the composite elastic yarn 40 through the heater and an optimized wound package build-up. Optimized package build-up includes a package having an acceptable stability, without overthrown ends, and an acceptable unwinding performance. Dependent on the desired composite elastic yarn properties and the package build-up, the surface speed of roll 28 should be from 0 to 6% greater than that of the wind-up drive roll 38.

Upon exiting the heater 32, the composite elastic yarn should cool sufficiently so that the yarn properties are not adversely affected when the yarn is wound onto wind-up roll 28. For spandex, it is known that cooling the spandex to about 60° C. or less before winding is sufficient. In the equipment configuration shown in FIGS. 1 and 2, cooling was by ambient air cooling of the yarn over a path length of about two to three meters from the exit of heater 32 to the wind-up roll 38 package. This exact distance for the yarn to traverse before winding depends in part upon the cooling method used, and could be shortened if cooling aids such as chilled rolls, chilled air or high-velocity air, for example, were used to accelerate cooling.

FIG. 3 shows equipment 50 that could be used to carry out an alternate embodiment of the method. Like reference numerals refer to like elements illustrated in. FIGS. 1 and 2. However, the SSM equipment 50 in FIG. 3 was further modified to enable two-stage hot drafting of the spandex yarn before the spandex enters the entangling jet 30. To achieve this, a 40-centimeter radiation heater 52, and another set of drafting rolls 54 were installed. The complete drafting between rolls 14 and 54 for two-stage drawing with applied heat ranges from 4.0× to 10.0×, and possibly as high as 15.0×. Thus, the spandex from roll 12 is drawn about 2.0× to 5.0× between rolls 14 and 20 in a first stage while heated within radiation heater 18. The maximum yarn temperature within the heater 18 is from about 80° C. to about 220° C. Then, the spandex is further drawn another 2.0× to 3.0× between rolls 20 and 54 while heated by heater 52. The maximum yarn temperature within the heater 52 is from about 150° C. to about 220° C., and may be the same temperature setting or a different temperature setting from the heating by heater 18. The heater 52 surface temperature ranges from 100° C. to 300° C., depending on the spandex yarn properties desired.

It is, of course, possible to use the equipment 50 shown in FIG. 3 to carry out a single stage drafting of the spandex prior to jet entangling by deactivating one or both of heaters 18 and 52, and appropriately setting the draft speed of rolls 20 and 54. Overall, the rolls 14, 20 and 54 act as spandex-draft gates, and one- or two-stage drafting of the spandex at different temperatures and total drafts can be achieved.

Alternatively, the equipment 10 shown in FIGS. 1 and 2 may be used to carry out a single stage drafting under ambient temperature by deactivating heater 18. The elastomeric yarn can be drawn (stretched from 2.0 to 5.0 times its relaxed length) while maintaining the yarn at an ambient temperature. Thereafter, the stretched elastomeric yarn and an inelastic yarn from package 22 can be fed through the fluid entangling jet 30 to entangle the elastomeric yarn and the inelastic yarn to form the composite elastic yarn. Preferably, the inelastic yarn is supplied to the jet at an overfeed from 1.5% to 6.0%. The composite elastic yarn then may be heated to a maximum temperature of between about 105° C. and about 240° C. by passing the yarn through heater 32. The composite yarn 40 is cooled prior to winding into a package on roll 38.

The maximum draft potential of spandex yarn is defined as the draft the yarn supports without breaking. Typically, the total draft ratio for spandex at room temperature is determined by its elongation to break minus a safety factor or margin when the spandex is processed in a continuous system. For continuous air-jet entangling of spandex, depending upon the spandex composition/elongation, maximum drafts of 4.5× or less are commonly used. While it has been taught that the maximum draft limit for spandex can be increased if the spandex is heated while drafting, it is surprising that using the methods according to the invention we achieve consistent draft ratios of 6.5× and above (up to 10.5×) for different spandex compositions under the drafting conditions used. Most surprisingly, the two-stage heated drafting of the spandex prior to jet entangling achieved consistent draft ratios above 8.0×.

The invention has particular advantage for spandex elastomeric yarns. Achieving higher spandex draft ratios in a covering process is one way to reduce the cost of composite elastic yarn production. It is typically more costly to spin spandex of lower deniers, e.g., 20 denier, than it is to spin higher-denier spandex, e.g., 70 denier. Thus, the cost savings are achieved where higher denier spandex can be used as the starting material in a composite-yarn forming process.

The maximum draft limit value includes any drafting or drawing of the elastomeric yarn (e.g., spandex) that is included in the package (bobbin) of as-spun yarn. This value of residual draft from spinning is termed package relaxation, PR, so that the total value of draft from subsequent processing is $D_t=(V_1/V_2)*(1+PR)$, where $D_t$ is the total draft, and $V_1/_2$ is the draft ratio of roll surface speeds from after-spin drafting. Typically, the PR number varies from 0.05 to 0.25.

As noted in the above Background of the Invention, an air-jet entanglement process (such as shown in Strachan, U.S. Pat. No. 3,940,917) makes a composite elastic yarn that has characteristic loops of inelastic covering yarn that protrude from the composite yarn surface. In hosiery fabric knit from these composite yarns, the loops partially obscure openings between knit stitches, thus contributing to opacity in the resulting hosiery. Where a more transparent knit hosiery is desired, the Strachan patent teaches that bicomponent inelastic covering yarns (filaments made of two polymer components with differential shrinkage under heat) can be used to improve transparency by the mechanism of polymer component differential shrinkage during fabric finishing processes. Bicomponent yarns, however, are significantly more expensive to manufacture than monocomponent yarns. Surprisingly, we have learned that the present invention can greatly improve the composite yarn structure made with monocomponent inelastic yarn (e.g., nylon) and elastomeric yarn (e.g., spandex), so that hosiery knitted and processed from such composite yarn has much better transparency than hosiery similarly made from standard air-jet textured yarn. The stitch clarity improvement results from forming the composite yarns using the proper process conditions for spandex drafting, for air-jet entangling, and for post heat-treatment of the composite yarn.

EXAMPLES

These examples illustrate the capabilities of the present invention, and unique results that heretofore have not been attained with other elastomeric yarn covering processes. These examples give preferred process conditions for the described equipment configurations and are meant to be illustrative, and not fully representative, of the capabilities of the invention.

A series of laboratory tests were conducted to determine the effects of spandex yarn temperature, spandex yarn properties, and multi-stage drafting on the maximum potential spandex draft. For one-stage drafting, a one-meter convection heater was equipped with a set of draft rolls before and after the heater. The heater was set to varying temperatures between 20° C. and 160° C. The speed difference of the two sets of rolls multiplied by (1+PR) determined the total draft. A yarn residence time of six (6) seconds in the heater was chosen to ensure that the yarn had reached equilibrium temperature prior to the exit from the heater. For each temperature tested, the draft was increased by increments of 0.2× until the spandex yarn broke.

FIG. 4 is a graph showing the maximum draft potential of three (3) 40-denier spandex yarns of different chemical compositions, each with four (4) coalesced filaments. Package relaxation factors (PR) for spandex type I, spandex type II and spandex type III were 0.10, 0.12 and 0.12, respectively (see Table 1 below for the chemical compositions). The maximum draft potential of all yarns increased with temperature until a maximum was reached. Thereafter, the maximum draft begins to decrease. The shape and level of the curves in FIG. 4 are composition dependent, being the highest for the yarn of composition type III.

TABLE 1

Chemical Composition of Spandex (Lycra*) Polymers Tested

| Composition Type | I | II | III |
|---|---|---|---|
| Capping ratio methylene- bis-(4-phenylisocyanate) and poly (tetramethylether) glycol | 1.69 | 1.70 | 2.05 |
| Glycol MW | 1800 | same | same |
| Chain extender 1 | ethylenediamine | same | same |

TABLE 1-continued

Chemical Composition of Spandex (Lycra*) Polymers Tested

| Composition Type | I | II | III |
|---|---|---|---|
| Chain extender 2 | 2-methylpentamethylene diamine | same | same |
| Mole ratio CE1/CE2 | 9:1 | 8:2 | 3:7 |
| Polymer concentration in solvent | 35% | same | same |

Figure 5:
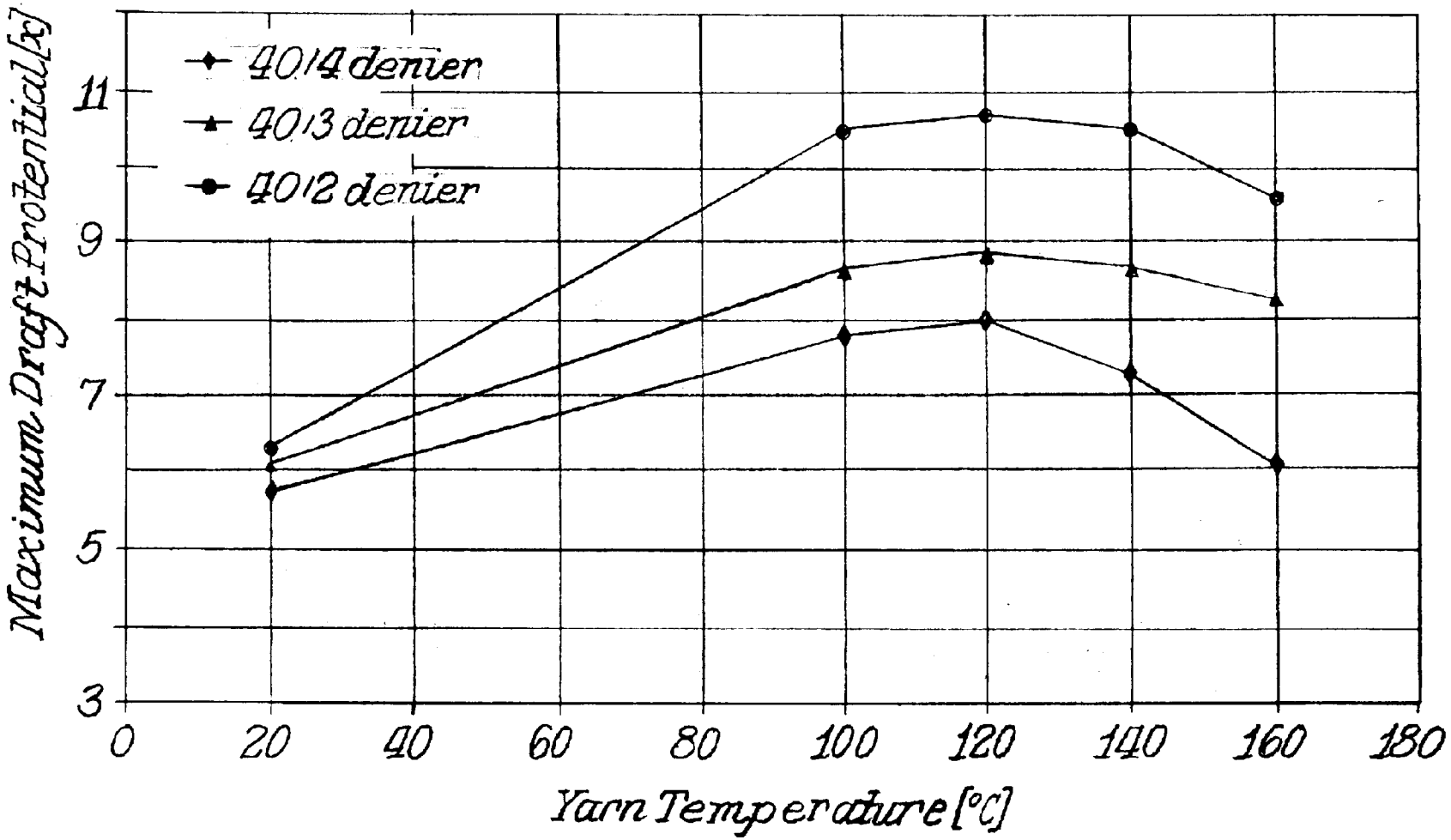
FIG. 5 is a graph of maximum single-step draft potential versus yarn temperature showing the effect of denier per filament and spandex temperature on the maximum single-step draft.

Another series of tests varied the yarn temperature and denier per filament of one spandex composition to determine the effect of temperature and denier per filament on the maximum draft potential. For these tests, the spandex polymer composition of Type I was used. Yarns of 40 denier, but with two, three or four filaments were tested (40/2, 40/3, 40/4). The package relaxation factor (PR) for the 40/2, 40/3 and 40/4 yarns were 0.10, 0.11 and 0.10, respectively. FIG. 5 shows that the maximum draft potential related to temperature, and also in part on the denier per filament. In short, yarns with higher denier per filament, e.g., 20 dpf, had a much higher draft potential than yarns with lower denier per filament, e.g., 10 dpf. Comparing FIG. 4 with FIG. 5, the spandex composition type III achieved the highest draft potential of the three spandex compositions shown in FIG. 4, yet the spandex composition type I can also achieve the higher draft potential when the yarn has a higher denier per filament. Thus, it is expected that using the drafting method with applied heat, draft ratios exceeding 10.5× can be achieved for yarns with spandex composition type III with higher denier per filament.

Figure 6:
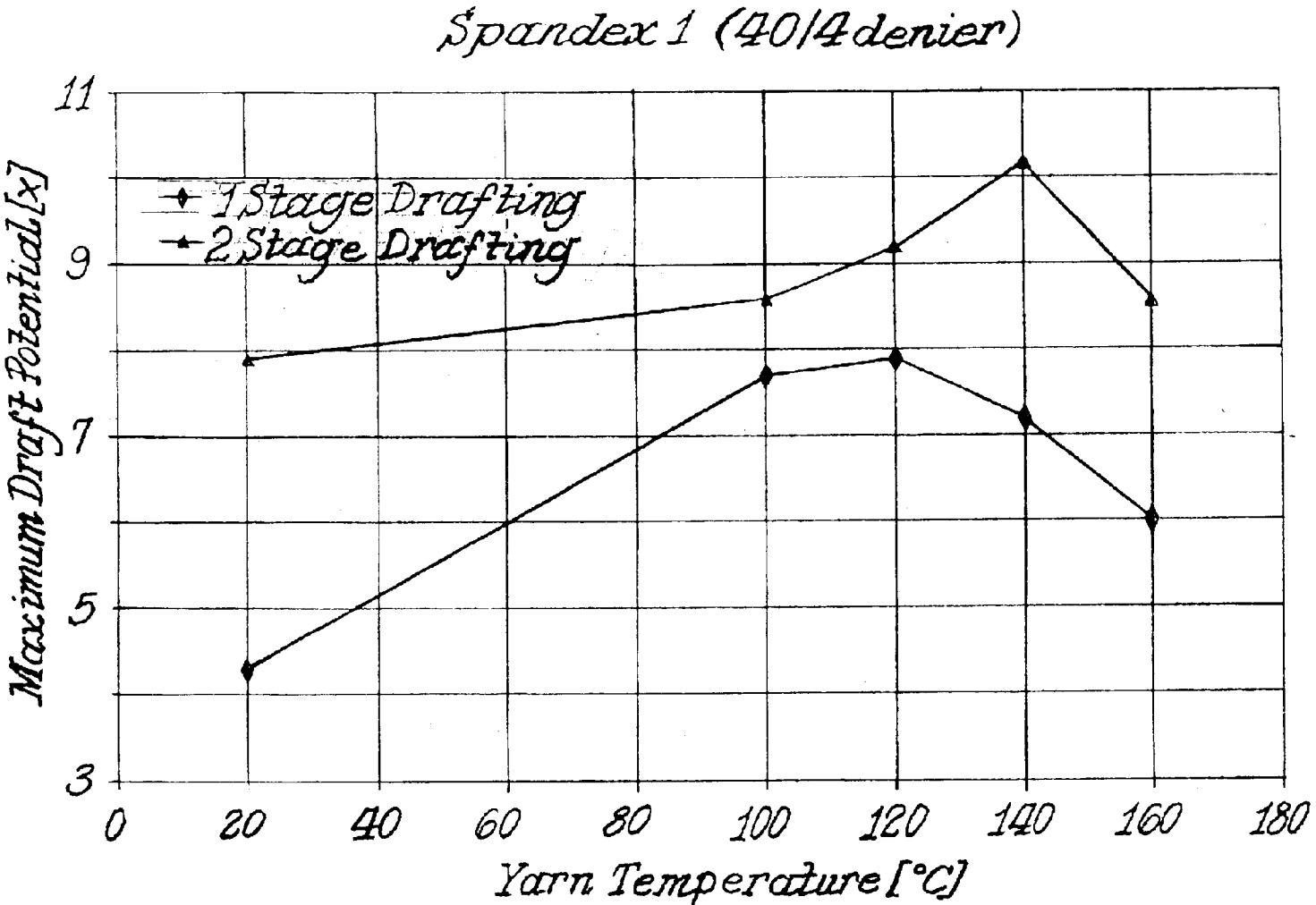
FIG. 6 is a graph of maximum draft potential versus yarn temperature showing the effect of two-stage drafting versus one-stage drafting on the maximum draft achievable by an identical spandex composition.

A third series of tests further demonstrated that two-stage drafting increases maximum draft potential compared to one-stage drafting. FIG. 6 compares the results of tests using spandex composition type I that have 40 denier and four filaments (e.g., 40/4), and a PR of 0.10. For the two-stage process, the spandex was drafted in the initial stage to 3.3× (230%) at 190° C. heater temperature and with a residence time of six (6) seconds. In the second stage the spandex draft was increased at steps of 0.2× and at the indicated temperature (e.g., 190° C.), with again a 6-second residence time, until the spandex broke. The two-stage drafting significantly increased the maximum draft potential. It is expected that multi-stage drafting (three or more drafting stages) will result in even higher draft potentials than single or two-stage drafting, provided the temperatures, drafts and residence times of all stages are optimized. However, we believe that the denier per filament of the drafted spandex should be at least about 1 to 2 dpf to achieve the maximum draft results and still have a useable composite yarn following jet entangling.

The above results are surprising in that high maximum potential draft ratios far beyond previous teachings of maximum potential of 8.0× were achieved. With an optimum chemical composition for the elastomeric yarn, and with a higher denier per filament (e.g., 20 dpf), and optionally with multi-stage drafting (e.g., two-stage or multiple stages) in advance of the entangling jet, these higher draft ratios (above 8×) may be reproducibly achieved. For most spandex compositions with higher denier per filament, the higher draft ratios (above 8.0×) may be achieved by using the multi-stage drafting in advance of the entangling jet.

For Examples 1 through 3 below, hosiery fabrics were knit from the composite elastic yarn of the test and compared with fabric results from control yarns. The different covered yarns were knit into women's pantyhose on a Matec HF 6.6 (4 inch dial, 402 needles) 6-feeder hosiery knitting machine from Matec SpA of Italy, operating at 600 rotations per minute, and into an every-course hose style. The machine was used as a two-feeder machine, knitting on one feeder a covered yarn with S torque and on the other feeder the same covered yarn with Z torque to create balanced hosiery. All hosiery samples were knit to the same medium size (all were knit with 2502 courses in the leg, with the stitch size adjusted to achieve a flat extended width of the steamed hose of 46 cm at the thigh and 29 cm at the calf). For the hosiery that was to be used to measure stitch clarity or openness, marker threads were inserted after 410 and 810 courses into the thigh area. After knitting, the hosiery was processed conventionally through cutting, sewing and dyeing.

In all test cases, the knit fabrics were evaluated for the following characteristics:

Stitch Clarity—Stitch Clarity is a measure of the visual openness of individual stitches, which relates to the transparency of the hosiery.

Dyed Hosiery Dimensions, Across Counter—The hosiery dimensions of a sample that a consumer views when selecting non-boarded hosiery.

Boarded Hosiery Dimensions—The hosiery dimensions of a sample that has been boarded and packaged for sale to consumers.

Hatra Pressure Profile, Dyed Hosiery—The Hatra pressure profile is a measure of the static hosiery compression forces along the leg that relate to its functionality while being worn.

Additional descriptions of some of these tests are given below:

Method to Measure Stitch Clarity in Pantyhose

To quantitatively measure the difference in transparency, we used an appropriate arrangement that measured the transmitted light through the knitted hosiery samples and quantified the results. In all cases, the hosiery samples were knit on the same knitting machine and stretched to the same cross and length strain by using a standard inspection board, and thus did not create differences in stitch openness from the test itself. Also, photomicrographs were made for close inspection of stitch openness. Representative photomicrographs at 32× magnification of a sample hosiery knit with conventional elastic yarn and elastic yarn according to the invention are included in FIGS. 7A and 7B, respectively. The stitch clarity is measured in the thigh area of the hosiery. To ensure that the hosiery is always extended equally and analyzed in the same place, one pulls a leg of the hosiery sample over a flat, trapezoidal inspection board of 110 cm length, of 25 cm circumference at the top and of 41 cm circumference at the bottom of the board. Preferably, the hose is dyed in black and the inspection board is white to increase the contrast between the open stitch area and the covered yarn. During knitting, marker threads are introduced after 410 and 810 courses and will be approximately 19 cm apart after the courses and stitches have been equalized. When the hose is pulled over the inspection board, it is extended to the same length and width. However, the hose might be more or less equalized along its length. By massaging the surface slightly, the courses and stitches find their equilibrium. The stitch clarity measurement is taken at the middle of the sample at an equal distance between the marker lines.

The inspection board carrying the hosiery sample is then viewed under a MZ-12 transmission microscope (from Leica, Germany) in the middle of the two marker threads. The image is transmitted by a color CCD-camera, model VCC-2972 produced by Sanyo, Japan to a personal computer, equipped with a videocard "Pinnacle/Studio PCTV-Vision". A 2× magnification is employed for the microscope, resulting in a 32× magnification of the PC image. The digital image is then changed into a black and white picture using "Photoshop-Version 5" (from Adobe, San Jose, Calif.). One gray shade range is chosen in order to determine the open area of the stitches, and another gray shade range is chosen to determine the composite yarn of spandex and the inelastic yarn, i.e., nylon in hosiery. The gray shade range from 0 to 244 is equated to black, the range from 245 to 255 is equated to white, and was chosen by plotting the area measured as a function of the gray shades. This resulted in an essentially bimodal distribution, one for the nylon (black) and one for the open area (white) with a bit of noise due to some reflection from the stitches. In the range around 245 the area is close to zero. The software "Image tool, version 2.03" (University of Texas Health Science Center, San Antonio, Tex. USA) is then used to calculate the percentage of area that is open, and not obscured by yarn or filaments. An increase in 5% in open area represents a very significant improvement in stitch clarity and in hosiery sheerness, or transparency.

Each image an area containing 140 stitches is analysed and averaged. Eighteen (18) areas are measured on each hosiery sample and analysed statistically.

Method to Measure Dyed Hosiery Dimensions, Across Counter

Measurements of hosiery length and width were done manually by placing the hose sample flat on a table and using a measuring tape.

Method to Measure Boarded Hosiery Dimensions

Each hosiery sample was put on a size 3 form and run through the Cortese Fissato Donna 684 boarding machine where it was exposed to 120° C. saturated steam. After boarding the hosiery dimensions were measured as for the dyed hose.

Hatra Pressure Profile Method, Dyed Hosiery

Measurement of hose pressure was done using the standard HATRA device of Segar, UK, and measuring at the ankle, calf and thigh portions of the hose.

In Example 4 below, woven fabric was prepared using the composite elastic yarns of the invention. This fabric was compared to fabrics woven from yarns of a standard air-jet covering process. The yarns were woven on a double loom, model P7100-390 from Sulzer, Switzerland into a 3:1 twill pattern. The control yarn and the yarn from the invention were used in the weft with a density of 22 picks/cm. The warp yarn consisted of a cotton yarn Number English (Ne) 20/1 with a density of 24 ends/cm. The resulting fabric was steam relaxed on a machine from Santex, Switzerland, and then scoured and dyed at boil in a jet dryer from MCS, Italy. Finally, the fabrics were heat set at 190° C. and 120 cm width for 60 seconds on a stenter frame from Brueckner, Germany.

The woven fabrics were analyzed for the following characteristics:

Weight

A fabric sample of 100 $cm^2$ was cut and weighed after 16 hours conditioning in a standard textile testing environment (21° C.+/−1° C. and 65+/−2% RH).

Spandex Content

A fabric sample of 100 $cm^2$ was separated into its components. After 16 hours of conditioning, the spandex yarn was weighed and the %-content is calculated.

Fabric Elongation

A conditioned fabric sample of 330 mm (weft)×60 mm (warp) was cut, at least 10 cm away from the fabric selvages. The sample was then unraveled in the weft direction to 50 mm width. The testing length of 250 mm was marked on the specimen with two parallel lines. The specimen was then mounted on a constant rate-of-extension tester, so that the inner edges of the clamps were exactly on the lines ruled on the specimen. The specimen was cycled three (3) times between 0–30 Newtons and the maximum elongation was calculated.

Fabric Recovery Power

Sample preparation and testing were the same as for evaluation of the fabric elongation. The recovery power was read from the graph on the third unload curve at the specified elongation.

Fabric Growth

Fabric specimens were extended to 80% of the fabric elongation and held in this state for 30 minutes. They were then allowed to relax for 60 minutes, at which time the fabric growth was measured and calculated in % from the original length. If 80% of the fabric elongation was greater than 35%, then the extension used for the growth test was limited to 35%.

Dimensional Stability

Permanent marks were made on a conditioned fabric specimen at predetermined distances. After laundering and drying, the specimen was reconditioned, and the distance between the marks was remeasured. The dimensional stability was then calculated as the change in the fabric's relaxed dimensions.

Example 1

In this example hosiery knitted from yarns of the invention were directly compared to hosiery knitted from yarns of a standard air-jet covering process. Both processes were operated on the SSM machine at a wind-up speed of 400 meters/minute.

According to the first aspect of the invention, this example compares pantyhose properties opposite the control hose when pre-entanglement single-stage hot drafting in combination with post-entanglement heat-treatment is used. A 20-denier spandex is drawn to the same denier in the covered yarn as a 12 denier in the control hose, made from the standard AJC non heat-treated control yarn. Two examples are given, where the only variable used for the two heat-treated examples consists in the heater temperature used during the first drawing step (160° C. and 190° C.). Detailed process conditions and results are given in Table 2 below. "AJC" denotes "air-jet covering" or air-jet entangling.

TABLE 2

| VARIABLES | AJC-CONTROL | AJC WITH PRE - And POST HEAT-TREATMENT | AJC WITH PRE - And POST HEAT-TREATMENT |
|---|---|---|---|
| Spandex yarn specs | | | |
| Type | Dry spun, type I | Same | Same |
| Denier | 12 | 20 | 20 |
| # filaments | 1 | 1 | 1 |

TABLE 2-continued

| VARIABLES | AJC-CONTROL | AJC WITH PRE - And POST HEAT-TREATMENT | AJC WITH PRE - And POST HEAT-TREATMENT |
|---|---|---|---|
| Nylon yarn specs | | | |
| Composition | Nylon 6.6 | Same | Same |
| Denier | 15 | Same | Same |
| # filaments | 7 | Same | Same |
| Textured | S + Z | Same | Same |
| AJC machine settings (FIG.1) | | | |
| Wind-up speed | 400 m/min | Same | Same |
| Roll surface speed (roll 28) | 412 m/min | 408 m/min | 408 m/min |
| Roll surface speed (roll 26) | 424 m/min | 420 m/min | 420 m/min |
| Roll surface speed (roll 20) | 412 m/min | 408 m/min | 408 m/min |
| Roll surface speed (roll 14) | 160 m/min | 89 m/min | 89 m/min |
| Draft (roll 28 to roll 14) | 2.6x | 4.6x | 4.6x |
| Total Draft | 3.1x | 5.1x | 5.1x |
| Spandex denier after drafting | 3.9 | 3.9 | 3.9 |
| Overfeed to jet | 3% | Same | Same |
| Jet Air Pressure | 4.5 bar | Same | Same |
| Jet type | Heberlein P212 | Same | Same |
| Heaters | | | |
| First Stage heater or heater 18 | Not used | Used | Used |
| Length | — | 40 cm | 40 cm |
| Residence time | — | 0.06 sec | 0.06 sec |
| Temperature | — | 160° C. | 190° C. |
| Second Stage heater (post air-jet) or heater 32 | | | |
| Length yarn path | 200 cm | Same | Same |
| Residence time | 0.3 sec | Same | Same |
| Temperature | Room temp. | 225° C. | 225° C. |
| Results Pantyhose | | | |
| Stitch Clarity | | | |
| White Area | 49.2% | 53.1% | 55.6% |
| Dyed Hose Dimensions-Across Counter | | | |
| Flat Length | 38 cm | 46.4 cm | 45.1 cm |
| Hatra Pressure Profile- Dyed Hose | | | |
| Thigh | 3.7 mmHg | 4.9 mmHg | 4.7 mmHg |
| Calf | 5.1 mmHg | 8.5 mmHg | 8.4 mmHg |
| Ankle | 5.9 mmHg | 11.4 mmHg | 9.4 mmHg |

The method used to measure knit stitch clarity, described above, quantifies the transmitted light through a standard number of knit stitches. For maximum clarity, which relates to sheerness, a composite yarn strand should be tightly consolidated, and should not have loose or errant fibers extending from the yarn to obscure light transmission. Single-covered composite elastic yarns that are manufactured by a slow, hollow-spindle process frequently have high stitch clarity. The less-consolidated composite elastic yarns produced with standard air-jet entangle processes usually have errant fibers extending from the yarn and thereby result in knit stitches that are generally the most obscured.

Surprisingly, however, the stitch clarity for the air-jet entangled yarns of the invention set forth in Table 2 were substantially improved for both cases versus the control. An improvement in stitch clarity of 5% is considered a very significant improvement in hosiery transparency.

Comparing the hosiery knitted with the composite yarn that was heated before and after entangling with hosiery knitted with the composite yarn of the control that was not heat treated before or after the entangling jet, the hose pressure has substantially increased and the flat hose length has only moderately increased. The present invention, when compared to standard air-jet entangling processes, can thus provide pantyhose with much improved transparency, with a higher Hatra profile, and at a reduced spandex feed yarn cost because of the higher denier. These properties make these composite yarns ideally suitable for sheer light support pantyhose.

Example 2

According to the second aspect of the invention, this example compares pantyhose properties opposite the control hose when two-stage pre-entanglement hot drafting in combination with post-entanglement heat-treatment is used (FIG. 3).

In the specific examples in Table 3 below, a 70-denier spandex is drawn (i) to about the same denier as a 20-denier spandex in the control (i.e., about 7.5 denier), and (ii) to a 10% lower denier than the control (i.e., about 6.7 denier).

TABLE 3

| VARIABLES | AJC-CONTROL | AJC WITH 2-STAGE PRE-TREATMENT AND POST HEAT-TREATMENT | AJC WITH 2-STAGE PRE-TREATMENT AND POST HEAT-TREATMENT |
|---|---|---|---|
| Spandex yarn specs | | | |
| Type | Dry spun, type 1 | Same | Same |
| Denier | 20 | 70 | 70 |
| # filaments | 2 | 5 | 5 |
| Nylon yarn specs | | | |
| Composition | Nylon 6.6 | Same | Same |
| Denier | 15 | Same | Same |
| # filaments | 7 | Same | Same |
| Textured | S + Z | Same | Same |
| AJC machine settings (FIG.3) | | | |
| Wind-up speed | 400 m/min | Same | Same |
| Roll surface speed (roll 28) | 412 m/min | Same | Same |
| Roll surface speed (roll 26) | 424 m/min | Same | Same |
| Roll surface speed (roll 54) | Not used | 412 m/min | 412 m/min |
| Roll surface speed (roll 20) | 412 m/min | 200 m/min | 178 m/min |
| Roll surface speed (roll 14) | 179 m/min | 50 m/min | 44.4 m/min |
| First Stage Draft (roll 20:roll 14) | 2.3x | 4.0x | 4.01x |
| Second St. Draft (roll 54:roll 20) | — | 2.06x | 2.31x |
| Draft Ratio (roll 28 to roll 14) | 2.3x | 8.2x | 9.3x |
| Total Draft | 2.6x | 9.3x | 10.5x |
| Spandex denier after Drafting | 7.7 | 7.5 | 6.7 |
| Overfeed to jet | 3% | Same | Same |
| Jet Air Pressure | 4.5 bar | Same | Same |
| Jet type | Heberlein P212 | Same | Same |
| Heaters | | | |
| First Stage heater (heater 18) | Not used | Used | Used |
| Length | — | 40 cm | Same |
| Residence time | — | 0.12 sec | 0.13 sec |
| Temperature | — | 190° C. | 190° C. |
| Second Stage heater (heater 52) | Not used | Used | Used |
| Length | — | 40 cm | Same |
| Residence Time | — | 0.06 sec | 0.06 sec |
| Temperature | — | 190° C. | 190° C. |
| Third Stage heater (post air-jet-heater 32) | | | |
| Length yarn path | 200 cm | Same | Same |
| Residence time | 0.3 sec | Same | Same |
| Temperature | Room temp. | 225° C. | 225° C. |
| Results Pantyhose | | | |
| Stitch Clarity | | | |
| White Area | 48.6% | 49.4% | 48.3% |
| Dyed Hose Dimensions-Across Counter | | | |
| Flat Length | 38.3 m | 41.3 cm | 38.9 cm |
| Hatra Pressure Profile- Dyed Hose | | | |
| Thigh | 4.8 mmHg | 6.6 mmHg | 6.4 mmHg |
| Calf | 7.5 mmHg | 10.3 mmHg | 11.9 mmHg |
| Ankle | 9.5 mmHg | 12.3 mmHg | 13.3 mmHg |

When comparing the above two-stage drafting to the Control, the stitch clarity was essentially equal, the Hatra pressure profile is moved to higher levels and the flat hose length has only moderately increased. The total draft levels are very high, however, (up to 0.5× in this example) and thus well suited to reduce spandex cost substantially in making an air-jet entangled composite elastic yarn. Both the stitch clarity and the Hatra pressure profile can be improved or adjusted by increasing the temperature of the drafting heaters, increasing the temperature in the post-jet heater, and/or increasing the residence time of the yarn in the heaters. Of course these heater temperatures, yarn residence times and yarn deniers must be such that the actual yarn temperature is within the limits of 80°–220° C. in the drafting heaters, and is within the limits of 150°–240° C. in the post-jet heater. Examples 1 and 3 also include some cases illustrating these effects.

Example 3

In an alternate embodiment of the invention, the elastomeric yarn (e.g., spandex) is drafted at room temperature, with heating following the jet-entangling step. Detailed process conditions and results are set forth in Table 4. In this example, the spandex drafting is at room temperature, and at a machine draft of 2.6× for the inventive process and for the control.

TABLE 4

| VARIABLES | AJC CONTROL | AJC WITH POST HEAT TREATMENT (Invention) | AJC WITH POST HEAT TREATMENT (Invention) | AJC WITH POST HEAT TREATMENT (Invention) |
|---|---|---|---|---|
| Spandex yarn specs | | | | |
| Composition | Dry spun, Type I | Same | Same | Same |
| Denier | 12 | Same | Same | Same |
| # filaments | 1 | Same | Same | Same |
| Nylon yarn specs | | | | |
| Composition | Nylon 6,6 | Same | Same | Same |
| Denier | 15 | Same | Same | Same |
| # filaments | 7 | Same | Same | Same |
| Textured | S + Z | Same | Same | Same |
| AJC machine settings (FIG. 1) | | | | |
| Wind-up speed | 400 m/min | 400 m/min | 200 m/min | 600 m/min |
| Roll surface speed (roll 28) | 412 m/min | 408 m/min | 204 m/min | 612 m/min |
| Roll surface speed (roll 26) | 424 m/min | 424 m/min | 210 m/min | 630 m/min |
| Roll surface speed (roll 20) | 412 m/min | 408 m/min | 204 m/min | 612 m/min |
| Roll surface speed (roll 14) | 160 m/min | 157 m/min | 78 m/min | 235 m/min |
| Draft (roll 28 to roll 14) | 2.6x | 2.6x | 2.6x | 2.6x |
| Total Draft | 3.1x | 3.1x | 3.1x | 3.1x |
| Spandex denier after drafting | 3.9 | 3.9 | 3.9 | 3.9 |
| Overfeed to jet (roll 26 to roll 28) | 3% | 3% | 3% | 3% |
| Jet air pressure | 4.5 bar | Same | Same | Same |
| Jet type | Heberlein P212 | Same | Same | Same |
| Heaters | | | | |
| Heater 18 | Not used | Not used | Not used | Not used |
| Heater 32 | | | | |
| Length yarn path | 2.0 m | Same | Same | Same |
| Residence time | 0.3 sec | 0.3 sec | 0.6 sec | 0.2 sec |
| Temperature | Room temperature | 225° C. | 40° C. | 240° C. |

| Results Pantyhose | CONTROL | INVENTION | INVENTION | INVENTION |
|---|---|---|---|---|
| Stitch Clarity | | | | |
| White Area | 49.2% | 54.9% | 58.0% | 51.7% |
| Dyed hose dimensions-across counter | | | | |
| Flat Length | 38 cm | 46.7 cm | 70.0 cm | 43.8 cm |
| Hatra Pressure Profile-Dyed Hose | | | | |
| Thigh | 3.7 mmHg | 3.3 mmHg | 1.6 mmHg | 3.4 mmHg |
| Calf | 5.1 mmHg | 5.1 mmHg | 2.7 mmHg | 5.2 mmHg |
| Ankle | 5.9 mmHg | 5.7 mmHg | 2.3 mmHg | 6.3 mmHg |

Figure 7B:
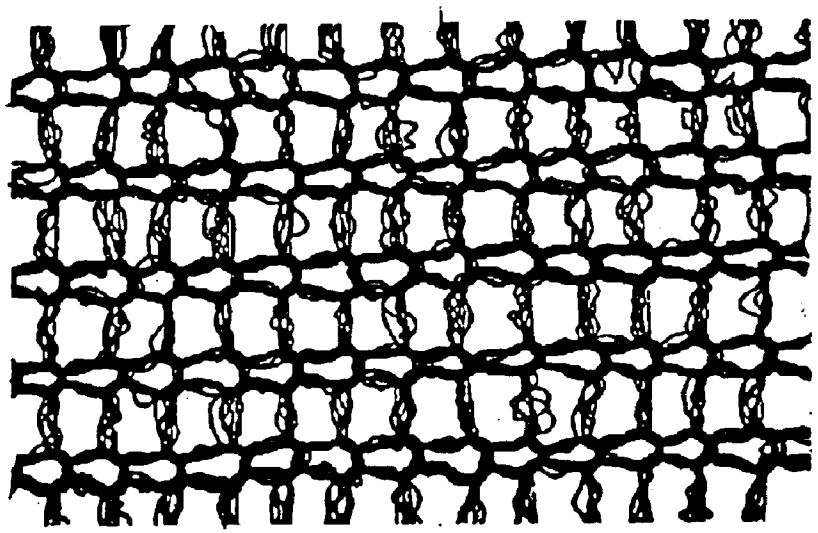
FIG. 7B is a photomicrograph of knit stitches from a composite elastic yarn of the invention (See Table 4, column 2).
Figure 7A:
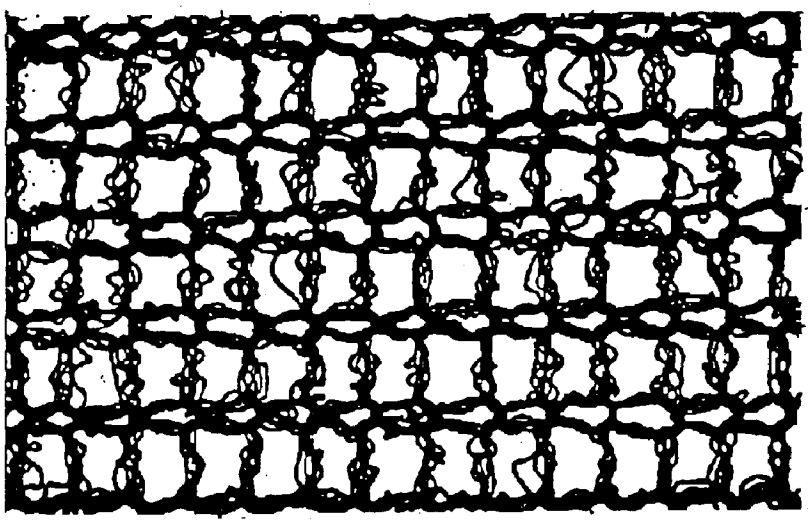
FIG. 7A is a photomicrograph of knit stitches made from a composite elastic yarn of a prior art air-jet covering process (see Table 4, column 1)

The stitch clarity of the finished hosiery made by the process of the invention (at wind-up speed 400 m/min and heat setting at 225° C.) improved significantly in white area from 49.2% to 54.9%. In FIGS. 7A and 7B, characteristic photomicrographs at 32× magnification for these two samples illustrate the difference in stitch clarity between 49.2% and 54.9%. The stitch openings of the sample in FIG. 7B are much more open, with fewer filament loops obscuring the openings between the knit stitches ("white area") as compared to the stitch openings of the sample in FIG. 7A (control).

Increasing the residence time of the elastic composite yarn in the heater also leads to improved stitch clarity (0.6 sec at 240° C. obtained stitch clarity at 58.0%). In addition to stitch clarity, the across-counter dimensions of the dyed hosiery and the hosiery after boarding have substantially improved.

Example 4

In this example, a heavy-denier composite elastic yarn was made according to the first aspect of the invention. A spandex yarn was single-stage drafted while heated, followed by jet with a covering yarn of polyester continuous filament yarns, and then followed by heating, cooling and winding of the composite yarn. For this example, the equipment set-up of FIGS. 1 and 2 was used with the following modification: An additional 40 cm long radiation heater was added between roll 14 and guide 16, increasing the total heater length in the pre-entangling zone to 80 cm to allow for higher heat input. A 70 denier spandex yarn was drawn to about the same denier in the covered yarn as 40 denier spandex is drawn in the non-heated control yarn. The covering yarn was composed of two (2) 70 denier, textured polyester yarns, each with 34 filaments, thereby giving the covering feed yarn a total denier of 140/68. Woven fabric using weft yarns of the invention was compared to fabric using weft yarns from a standard air-jet covering process.

Table 5 below sets forth the results of the tests.

TABLE 5

| Variables | AJC Control | AJC with PRE and POST Heat Treatment |
|---|---|---|
| Spandex Yarn specs | | |
| Type | Dry Spun, Type I | Same |
| Denier | 40 | 70 |
| # filaments | 4 | 5 |
| Hard Yarn specs | | |
| Composition | PES | Same |
| Denier | 2 × 70 | Same |
| # filaments | 34 | Same |
| Textured | S + Z | Same |
| AJC machine settings (FIG. 1) | | |
| Wind-up speed | 400 m/min | Same |
| Roll surface speed (roll 14) | 117 m/min | 67.3 m/min |
| Roll surface speed (roll 20) | 410 m/min | Same |
| Roll surface speed (roll 26) | 420 m/min | Same |
| Roll surface speed (roll 28) | 410 m/min | Same |
| Draft (roll 28 to roll 14) | 3.50x | 6.09x |
| Total draft | 4.0x | 6.7x |
| Overfeed to jet (roll 26 vs. roll 28) | 2.4% | Same |
| Jet type | Heberlein P212 | Same |
| Jet air pressure | 4.5 bar | Same |
| Heaters | | |
| First Stage heater or heater 18 | Not used | Used |
| length | — | 80 cm |
| Temperature | — | 160° C. |
| Residence time | — | 0.12 sec |
| Second Stage Heater (post air-jet) or heater 32 | | |
| length of yarn path | 200 cm | Same |
| Temperature | Room Temperature | 225° C. |
| Residence time | 0.3 sec | Same |
| Woven Fabric Results | | |
| Weight | 193 g/m$^2$ | 207 g/m$^2$ |

TABLE 5-continued

| Variables | AJC Control | AJC with PRE and POST Heat Treatment |
|---|---|---|
| Spandex Content | 2.4% | 2.3% |
| Fabric Elongation | 55.2% | 66.2% |
| Fabric Recovery Power | | |
| @20% fabric elongation | 42 cN | 52 cN |
| @10% fabric elongation | 1.7 cN | 11 cN |
| Fabric Growth | 3.7% | 2.7% |
| Dimensional Stability | −0.2% | −0.2% |

Surprisingly, we found desirable fabric properties hitherto not possible with standard spandex yarn. The fabric elongation of the fabric produced with the yarn of the invention increased. At the same time the fabric recovery power had increased substantially at low fabric elongation while the fabric growth had appreciably reduced. While heat treatment of spandex yarn to change yarn and fabric properties is well known, the combination of high fabric elongation with high recovery power at low fabric elongation and improved fabric growth is unique. These properties are of prime importance for garments made from woven fabrics. The superior performance in recovery power and fabric growth results in better garment fit and reduced "bagging" propensity, and the higher elongation improves the comfort of the fabrics. The yarns of this invention thus are suited also for woven garments.

While the invention has been described in connection with preferred embodiments, variations within the scope of the invention will likely occur to those skilled in the art. Thus, it is understood that the invention is covered by the following claims.

We claim:

1. A method for producing a composite elastic yarn, comprising:

a) stretching an elastomeric yarn of 10 to 140 denier and 1 to 15 filaments to from 2.0 to 7.0 times its relaxed length while heating the yarn to a temperature in the range of about 80° C. to about 150° C.;

b) jointly feeding the stretched elastomeric yarn and an inelastic yarn of 10 to 210 denier and having at least five filaments through a fluid entangling jet to entangle the elastomeric yarn and the inelastic yarn to form the composite elastic yarn, said to inelastic yarn being supplied to the jet at an overfeed from 1.5% to 6.0%;

c) heating the composite elastic yarn to a maximum temperature of between about 150° C. and about 240° C.; and d) cooling the heated composite yarn to an average temperature of about 60° C. or less, prior to winding the composite yarn into a package.

2. The method of claim 1, wherein the elastomeric yarn is spandex comprised of individual filaments having denier in the range of 6 to 25 that are coalesced together.

3. The method of claim 1, wherein the inelastic yarn is a multifilament synthetic yarn selected from the group consisting of nylon and polyester yarns.

4. The method of claim 1, wherein the composite elastic yarn exits the fluid entangling jet at a speed of from 350 to 700 meters per minute.

5. The method of claim 1, further comprising stretching the elastomeric yarn up to an additional 2.0 times its length as the yarn is drawn through the fluid entangling jet.

6. The method of claim 1, wherein the elastomeric yarn is heated in an in-line heater for a residence time less than 0.5 second.

7. The method of claim 1, wherein the composite elastic yarn is heated in an in-line heater for a residence time less than one second.

8. The method of claim 1, wherein the elastomeric yarn is stretched to at least eight times its relaxed length before the yarn is drawn through the fluid entangling jet.

9. A composite elastic yarn formed by the method of claim 1.

10. A garment, including hosiery, formed at least in part with a composite elastic yarn formed by the method of claim 1.

11. A method for producing a composite elastic yarn, comprising:

a) stretching an elastomeric yarn of 10 to 140 denier and 1 to 15 filaments to from 2.0 to 5.0 times its relaxed length while heating the yarn to a temperature in the range of about 80° C. to about 220° C. in a first heating zone;

b) further stretching the elastomeric yarn an additional 2.0 to 3.0 times its stretched length while heating the yarn to a temperature in the range of about 80° C. to 220° C. in a second heating zone;

c) jointly feeding the stretched elastomeric yarn and an inelastic yarn of 10 to 210 denier and having at least five filaments through a fluid entangling jet to entangle the elastomeric yarn and the inelastic yarn to form the composite elastic yarn, said inelastic yarn being supplied to the jet at an overfeed from 1.5% to 6.0%;

d) heating the composite elastic yarn to a maximum temperature of between about 150° C. and about 240° C. in a third heating zone; and e) cooling the heated composite yarn to an average temperature of about 60° C. or less, prior to winding the composite yarn into a package.

12. The method of claim 11, wherein the elastomeric yarn is spandex comprised of individual filaments having denier in the range of 6 to 25 that are coalesced together.

13. The method of claim 11, wherein the inelastic yarn is a multifilament synthetic yarn selected from the group consisting of nylon and polyester yarns.

14. The method of claim 11, wherein the composite elastic yarn exits the fluid entangling jet at a speed of from 350 to 700 meters per minute.

15. The method of claim 11, further comprising stretching the elastomeric yarn up to an additional 2.0 times its length as the yarn is drawn through the fluid entangling jet.

16. The method of claim 11, wherein the elastomeric yarn is heated in two heating zones for a total residence time of less than 0.5 second.

17. The method of claim 11, wherein the composite elastic yarn is heated in an in-line heater for a residence time less than one second.

18. The method of claim 11, wherein the elastomeric yarn is stretched to at least eight times its relaxed length before the yarn is drawn through the fluid entangling jet.

19. A composite elastic yarn formed by the method of claim 11.

20. A garment, including hosiery, formed at least in part with a composite elastic yarn formed by the method of claim 11.

21. A method for producing a composite elastic yarn, comprising:

a) stretching an elastomeric yarn of 10 to 140 denier and 1 to 5 filaments to from 2.0 to 5.0 times its relaxed length while the yarn is at ambient temperature;

b) jointly feeding the stretched elastomeric yarn and an inelastic yarn of 10 to 210 denier and having at least five filaments through a fluid entangling jet to entangle the elastomeric yarn and the inelastic yarn to form the composite elastic yarn, said inelastic yarn being supplied to the jet at an overfeed from 1.5% to 6.0%;

c) heating the composite elastic yarn to a maximum temperature of between about 150° C. and about 240° C.; and d) cooling the heated composite yarn to an average temperature of about 60° C. or less, prior to winding the composite yarn into a package.

22. The method of claim 21, wherein the elastomeric yarn is spandex comprised of individual filaments having denier in the range of 6 to 25 that have been coalesced together.

23. The method of claim 21, wherein the inelastic yarn is selected from the group consisting of: polyamides including nylon and polyester.

24. The method of claim 21, further comprising stretching the elastomeric yarn up to an additional 2.0 times its length as the yarn is drawn through the fluid entangling jet.

25. The method of claim 21, wherein the composite elastic yarn is heated in an in-line heater for a residence time less than one second.

26. A composite elastic yarn formed by the method of claim 21.

27. A garment, including hosiery, formed at least in part with a composite elastic yarn formed by the method of claim 21.

* * * * *

UNITED STATES PATENT AND TRADEMARK OFFICE

CERTIFICATE OF CORRECTION

PATENT NO. : 6,848,151 B2
DATED : February 1, 2005
INVENTOR(S) : Willem Bakker et al.

It is certified that error appears in the above-identified patent and that said Letters Patent is hereby corrected as shown below:

Title page,
Item [73], Assignee, "Invista Norh America S.á r.l." should read
-- Invista North America S.á r.l. --.

Column 20,
Line 48, "said to inelastic" should read -- said inelastic --.

Signed and Sealed this

Third Day of May, 2005

JON W. DUDAS
*Director of the United States Patent and Trademark Office*